US008216952B2

(12) United States Patent
Oki et al.

(10) Patent No.: US 8,216,952 B2
(45) Date of Patent: Jul. 10, 2012

(54) FABRIC TREATING AGENT, PROCESS FOR PRODUCING FABRIC, AND FABRIC FOR VEHICLE INTERIOR MATERIALS

(75) Inventors: Tatsuya Oki, Osaka (JP); Masateru Kotera, Osaka (JP); Yoshihiro Kando, Osaka (JP)

(73) Assignee: Matsumoto Yushi-Seiyaku Co., Ltd., Osaka (JP)

( * ) Notice: Subject to any disclaimer, the term of this patent is extended or adjusted under 35 U.S.C. 154(b) by 580 days.

(21) Appl. No.: 12/311,772

(22) PCT Filed: Oct. 17, 2007

(86) PCT No.: PCT/JP2007/001124

§ 371 (c)(1),
(2), (4) Date: Apr. 10, 2009

(87) PCT Pub. No.: WO2008/047474

PCT Pub. Date: Apr. 24, 2008

(65) Prior Publication Data

US 2010/0035493 A1 Feb. 11, 2010

(30) Foreign Application Priority Data

Oct. 20, 2006 (JP) ..... 2006-312202

(51) Int. Cl.
*B32B 5/02* (2006.01)

(52) U.S. Cl. ..... 442/100; 442/97

(58) Field of Classification Search ..... 442/97, 442/100

See application file for complete search history.

(56) References Cited

U.S. PATENT DOCUMENTS

| | | | | |
|---|---|---|---|---|
| 5,389,136 | A | 2/1995 | Danner | |
| 5,494,593 | A * | 2/1996 | Schleusener | 252/8.63 |
| 2003/0150467 | A1 | 8/2003 | Robinson | |
| 2008/0241532 | A1 | 10/2008 | Wattenhofer et al. | |

FOREIGN PATENT DOCUMENTS

| | | |
|---|---|---|
| EP | 1 711 559 A1 | 10/2006 |
| JP | 53-35811 | 9/1978 |
| JP | 58-174684 | 10/1983 |
| JP | 04-057965 | 2/1992 |
| JP | 04-073265 A | 3/1992 |
| JP | 06-507443 | 8/1994 |
| JP | 09-170172 | 6/1997 |
| JP | 10-053996 | 2/1998 |
| JP | 2001-525016 | 12/2001 |
| JP | 2003-336139 | 11/2003 |
| JP | 2006-210228 | 8/2006 |
| JP | 2006-326406 | 12/2006 |
| JP | 2007-533791 | 11/2007 |

OTHER PUBLICATIONS

"Resin and Plastic, Cyclopaedia of Chemistry and Engineering", professional edition, p. 1439, published on Jan. 31, 2003, with its partial translation (from left column, line 2 to right column line 18).

* cited by examiner

*Primary Examiner* — Lynda Salvatore

(74) *Attorney, Agent, or Firm* — Carrier Blackman & Associates, P.C.; William D. Blackman; Joseph P. Carrier

(57) ABSTRACT

The object of the present invention is to provide a fabric treating agent to satisfy good sewability required to interior material fabrics for vehicles including automobiles and trains, the good sewability which arises from the trend toward ultrafiner fibers for manufacturing the fabrics, change in fabric structure from weave to knit, and increasing sewing machine speed.

The present invention provides the fabric treating agent comprising at least one wax (a) selected from the group consisting of a paraffin wax having a melting point of 60° C. or higher, an oxidized paraffin wax having a melting point of 60° C. or higher, a polyethylene wax having a melting point of 100° C. or higher, and an oxidized polyethylene wax having a melting point of 100° C. or higher; and a nonionic surfactant (b). The present invention also provides a process for producing fabrics applied with the fabric treating agent, and provides vehicle interior material fabrics.

20 Claims, No Drawings

FABRIC TREATING AGENT, PROCESS FOR PRODUCING FABRIC, AND FABRIC FOR VEHICLE INTERIOR MATERIALS

TECHNICAL FIELD

The present invention relates to a fabric treating agent, a process for producing fabrics with the fabric treating agent, and fabrics having good sewability for vehicle interior materials. More specifically, present invention relates to a fabric treating agent which is applied to interior material fabrics for vehicles including automobiles and trains in order to impart lubricity (good sewability) to the fabrics and prevent fabric yarn from cutting during machine sewing.

TECHNICAL BACKGROUND

Conventional fabric treating agents for imparting good sewability to fabrics of hydrophobic synthetic fibers include a treating agent described in Patent Reference 1, which comprises a water-absorbent agent, softening and lubricating agent, and water-soluble silicones; and a fiber-treating agent described in Patent Reference 2, which consisting essentially of at least one wax selected from the group consisting of hydrocarbon waxes, their oxidized products, vegetable waxes, and animal waxes; and a fatty acid ester of a polyhydric alcohol-alkylene oxide adduct.

[Patent Reference 1] JP 58-174684 A

[Patent Reference 2] JP 4-73265 A

DISCLOSURE OF INVENTION

Technical Problem

Conventional fiber-treating agents have failed to achieve desirable sewability of fabrics. In addition, those agents cannot satisfy higher degree of sewability required to fabrics in the field of vehicle interior materials, where the trend toward fabrics of ultrafine fibers (made to fine denier), change in fabric structure from weave to knit, and increasing sewing machine speed for improved productivity are emerging recently in the production of interior material fabrics for vehicles such as automobiles and trains, especially fabrics for car seats.

Under such situation, the present invention provides a fabric treating agent for imparting excellent sewability to fabrics, a process for producing fabrics with the fabric treating agent, and fabrics for vehicle interior materials.

Technical Solution

The inventors of the present invention studied diligently to attain the target described above, and found that a fabric treating agent comprising a specific wax and nonionic surfactant could impart excellent sewability, good lubricity, fogging preventability (performance to prevent the emission of chemicals contained in vehicle interior materials so as to prevent the fogging of transparent parts of vehicles which is caused by the adsorption of the emitted chemicals ), and abrasion fastness to fabrics, and had good stability. Thus the inventors have achieved the present invention. The fabric treating agent of the present invention comprises at least one wax (a) selected from the group consisting of a paraffin wax having a melting point of 60° C. or higher, an oxidized paraffin wax having a melting point of 60° C. or higher, a polyethylene wax having a melting point of 100° C. or higher, and an oxidized polyethylene wax having a melting point of 100° C. or higher; and a nonionic surfactant (b).

The wax (a) preferably comprises a paraffin wax (a1) having a melting point of 60° C. or higher, and a polyethylene wax (a2) having a melting point of 100° C. or higher and/or an oxidized polyethylene wax (a2) having a melting point of 100° C. or higher, wherein the weight ratio between the component (a1) and component (a2) should preferably range from 98:2 to 50:50.

The wax (a) also preferably comprises a paraffin wax (a1) having a melting point of 60° C. or higher, and an oxidized paraffin wax (a3) having a melting point of 60° C. or higher, wherein the weight ratio between the wax (a1) and the wax (a3) should preferably range from 98:2 to 80:20.

The ratio of the wax (a) preferably ranges from 60 to 90 wt % of the total amount of the wax (a) and the nonionic surfactant (b).

The fabric treating agent of the present invention may further comprise an anionic surfactant (c), wherein the ratio of the wax (a) preferably ranges from 60 to 90 wt % of the total amount of the wax (a), the nonionic surfactant (b), and the anionic surfactant (c). It is further preferable that the weight ratio between the nonionic surfactant (b) and the anionic surfactant (c) ranges from 5:1 to 50:1.

The anionic surfactant (c) is preferably represented by the chemical formula (1) or (2) shown below.

[Chem. 1]

$$R^1—OSO_3M^1 \quad (1)$$

(where $R^1$ is a $C_8$-$C_{40}$ alkyl group or $C_8$-$C_{40}$ alkenyl group, $M^1$ is a hydrogen atom, alkaline metal, alkaline earth metal or a group represented by $NR^3R^4R^5R^6$, and each of $R^3$, $R^4$, $R^5$ and $R^6$ is independently a hydrogen atom or an organic group.)

[Chem. 2]

$$R^2—SO_3M^2 \quad (2)$$

(where $R^2$ is a $C_8$-$C_{40}$ organic group, $M^2$ is a hydrogen atom, alkaline metal, alkaline earth metal or a group represented by $NR^3R^4R^5R^6$, and each of $R^3$, $R^4$, $R^5$ and $R^6$ is independently a hydrogen atom or an organic group.)

The nonionic surfactant (b) preferably contains the nonionic surfactants (b1), (b2), and (b3) in the ratio as described below.

(b1): a nonionic surfactant having HLB of from 1 to 7 (but excluding 7), constituting 5 to 40 wt % of the nonionic surfactant (b).

(b2): a nonionic surfactant having HLB of from 7 to 14 (but excluding 14), constituting 10 to 80 wt % of the nonionic surfactant (b).

(b3): a nonionic surfactant having HLB of from 14 to 20 (but excluding 20), constituting 5 to 40 wt % of the nonionic surfactant (b).

The wax (a) is preferably in the state of an oil-in-water dispersion.

The process for producing the fabric provided by the present invention utilizes the techniques, such as a dipping method, an impregnate method, a pad-dry method, spraying or coating, for treating fabric materials with the fabric treating agent. The preferable fabric materials for the treatment are those manufactured of ultrafine fiber. The vehicle interior material fabric of the present invention should preferably be applied with the solids of the fabric treating agent by 0.01 to 20 wt % of the weight of fabric material.

Advantageous Effects

The fabric treating agent of the present invention imparts excellent sewability to fabrics. In other words, fabrics applied with the fabric treating agent acquire improved lubricity which decreases friction and abrasion between fabric yarn strands or between fabric yarn and a sewing-machine needle so as to minimize fabric yarn breakage during sewing operation. Further the fabric treating agent imparts excellent sewability to fabrics which are difficult to be sewn due to ultrafine fiber constituting the fabrics, changed fabric structure from weave to knit, and increasing sewing machine speed for improved productivity. Owing to such performance, the fabric treating agent attains high processability of fabrics and improved seam in sewing process to provide higher quality vehicle interior material fabrics.

BEST MODE FOR CARRYING OUT THE INVENTION

The fabric treating agent of the present invention comprises a specific wax (a) and a specific nonionic surfactant (b) as in the detailed description given below.

The wax (a) employed in the present invention comprises at least one selected from the group consisting of a paraffin wax having a melting point of 60° C. or higher, an oxidized paraffin wax having a melting point of 60° C. or higher, a polyethylene wax having a melting point of 100° C. or higher, and an oxidized polyethylene wax having a melting point 100° C. or higher. In other words, one or more of those waxes may be employed, and the variants and the ratio of two or more of those waxes to be employed are not specifically restricted. Those waxes having such high melting points contribute to improved lubricity of fabric yarn strands and excellent sewability of treated fabrics. In addition, the waxes are emitted from treated fabric in a remarkably small amount during storage or drying, and such property will minimize fogging on vehicle parts. The melting point of the wax (a) of the present invention is that determined according to JIS-K-2235-5.3.1. In the determination procedure, a melted sample was placed in a sample container and gradually cooled in water bath. The temperature of the sample was determined every 15 seconds until five consecutive temperature values having a difference within 0.1° C. were obtained. Then the five temperature values were averaged to determine the melting point of the sample.

The paraffin wax employed in the present invention has a melting point of 60° C. or higher. The melting point preferably ranges from 65 to 90° C., more preferably from 65 to 80° C., and further more preferably from 65 to 75° C. A paraffin wax having a melting point below 60° C. results in insufficient lubricity of fabrics treated with the fabric treating agent to cause poor sewability of the fabrics, or may result in poor fogging preventability. On the other hand, a paraffin wax having a melting point over 90° C. exhibits poor emulsification in the fabric treating agent when the paraffin wax is dispersed and emulsified in water as the wax (a) (hereinafter sometimes referred to as the emulsifiability of the fabric treating agent), or results in poor stability of the fabric treating agent or the dilution of the fabric treating agent (hereinafter sometimes referred to as the stability of the fabric treating agent). The poor emulsification or stability may sometimes inhibit uniform application of the fabric treating agent on fabrics.

The paraffin wax is a saturated hydrocarbon of linear or branched structure, and a n-paraffin wax ($C_nH_{2n+2}$), which is a linear saturated hydrocarbon, is preferable. The carbon number of the paraffin wax preferably ranges from 27 to 36, more preferably from 28 to 34, and further more preferably from 29 to 32. A paraffin wax having a carbon number less than 27 may result in insufficient lubricity of fabrics treated with the fabric treating agent to cause poor sewability of the fabrics. On the other hand, a paraffin wax having a carbon number over 36 results in poor emulsifiability and stability of the resultant fabric treating agent and may inhibit uniform application of the agent on fabrics.

The molecular weight of the paraffin wax preferably ranges from 380 to 500, more preferably from 390 to 480, and further more preferably from 410 to 450. A paraffin wax having a molecular weight less than 380 may result in insufficient lubricity of fabrics treated with the fabric treating agent to cause poor sewability of the fabrics. On the other hand, a paraffin wax having a molecular weight over 500 results in poor emulsifiability and stability of the resultant fabric treating agent and may inhibit uniform application of the agent on fabrics. The paraffin wax may comprise one or more of the paraffin waxes mentioned above, or may comprise a n-paraffin wax as a major component (95 wt % or more, preferably 97 wt %, and more preferably 99 wt % or more) and a small amount of a branched saturated hydrocarbon (i-paraffin).

The oxidized paraffin wax employed in the present invention has a melting point of 60° C. or higher. The melting point preferably ranges from 60 to 90° C., more preferably from 65 to 85° C., and further more preferably from 70 to 80° C. An oxidized paraffin wax having a melting point less than 60° C. may result in insufficient lubricity of fabrics treated with the fabric treating agent to cause poor sewability of the fabrics, or may result in poor fogging preventability. On the other hand, an oxidized paraffin wax having a melting point over 90° C. results in poor emulsifiability and stability of the resultant fabric treating agent and may inhibit uniform application of the agent on fabrics.

The oxidized paraffin wax is produced by oxidizing the above-mentioned paraffin wax with oxygen or oxygen-containing air. The oxidized paraffin wax has a structure containing a hydroxyl group, carboxyl group, carbonyl group, etc. in the structure of the paraffin wax. The acid value of the oxidized paraffin wax preferably ranges from 6 to 19, more preferably from 8 to 17, and further more preferably from 10 to 15 for improving the emulsifiability and stability of the fabric treating agent and for applying the fabric treating agent uniformly on fabrics. Such acid value range is preferable for blending the oxidized paraffin wax in combination with the paraffin wax in the fabric treating agent as mentioned below.

The carbon number of the oxidized paraffin wax preferably ranges from 27 to 36, more preferably from 28 to 34, and further more preferably from 29 to 32. An oxidized paraffin wax having a carbon number less than 27 may result in insufficient lubricity of fabrics treated with the fabric treating agent to cause poor sewability of the fabrics. On the other hand, an oxidized paraffin wax having a carbon number over 36 results in poor emulsifiability and stability of the resultant fabric treating agent and may inhibit uniform application of the agent on fabrics. The molecular weight of the oxidized paraffin wax preferably ranges from 430 to 550, more preferably from 440 to 530, and further more preferably from 460 to 500. An oxidized paraffin wax having a molecular weight less than 430 may result in insufficient lubricity of fabrics treated with the fabric treating agent to cause poor sew ability of the fabrics. On the other hand, an oxidized paraffin wax having a molecular weight over 550 results in poor emulsifiability and stability of the resultant fabric treating agent and may inhibit uniform application of the agent on fabrics. The oxidized paraffin wax may comprise one or more of the oxidized paraffin waxes mentioned above.

The polyethylene wax employed in the present invention has a melting point of 100° C. or higher. The melting point preferably ranges from 100 to 160° C., more preferably from 120 to 150° C., and further more preferably from 130 to 140° C. A polyethylene wax having a melting point less than 100° C. results in insufficient lubricity of fabrics treated with the fabric treating agent to cause poor sewability of the fabrics, and may result in poor fogging preventability. On the other hand, a polyethylene wax having a melting point over 160° C. may results in poor emulsifiability and stability of the resultant fabric treating agent and may inhibit uniform application of the agent on fabrics.

The polyethylene wax is produced in several processes, for example, polymerization of ethylene monomer, production of low-molecular-weight polyethylene by thermal decomposition of polyethylene for moldings, and separation and refinement of low-molecular-weight polyethylene generated as a byproduct in the production of polyethylene for moldings. The side chains of the polyethylene wax employed in the present invention increase with the decrease of the density of the polyethylene wax. A polyethylene wax having a great number of side chains result in poor lubricity of fabrics treated with the resultant fabric treating agent and may cause poor sewability of the fabrics. For avoiding such problem, the density of the polyethylene wax should preferably range from 0.90 to 0.99 g/ml, more preferably from 0.94 to 0.98 g/ml, and further more preferably from 0.96 to 0.97 g/ml. The molecular weight of the polyethylene wax employed in the present invention preferably ranges from 2000 to 5000, more preferably from 2500 to 4500, and further more preferably from 3000 to 4000. A polyethylene wax having a molecular weight less than 2000 may result in poor lubricity of fabrics treated with the resultant fabric treating agent, and may cause poor sewability of the fabrics. On the other hand, a polyethylene wax having a molecular weight over 5000 may results in poor emulsifiability and stability of the resultant fabric treating agent and may inhibit uniform application of the agent on fabrics. The polyethylene wax may comprise one or more of the polyethylene waxes mentioned above.

The oxidized polyethylene wax employed in the present invention has a melting point of 100° C. or higher. The melting point preferably ranges from 100 to 180° C., more preferably from 120 to 160° C., and further more preferably from 130 to 150° C. An oxidized polyethylene wax having a melting point less than 100° C. results in insufficient lubricity of fabrics treated with the fabric treating agent to cause poor sewability of the fabrics, and may result in poor fogging preventability. On the other hand, an oxidized polyethylene wax having a melting point over 180° C. may results in poor emulsifiability and stability of the resultant fabric treating agent and may inhibit uniform application of the agent on fabrics.

The oxidized polyethylene wax is produced by oxidizing the above-mentioned polyethylene wax with oxygen or oxygen-containing air. The oxidized polyethylene wax has a structure containing a hydroxyl group, carboxyl group, carbonyl group, etc. in the structure of the polyethylene waxes. The acid value of the oxidized polyethylene wax preferably ranges from 3 to 100, more preferably from 5 to 50, and further more preferably from 7 to 30 for improving the emulsifiability and stability of the fabric treating agent and for applying the fabric treating agent uniformly on fabrics.

The side chains of the oxidized polyethylene wax employed in the present invention increase with the decrease of the density of the oxidized polyethylene wax. An oxidized polyethylene wax having a great number of side chains results in poor lubricity of fabrics treated with the fabric treating agent and may cause poor sewability of the fabrics. For avoiding such problem, the density of the oxidized polyethylene wax should preferably range from 0.90 to 0.99 g/ml, more preferably from 0.94 to 0.98 g/ml, and further more preferably from 0.96 to 0.97 g/ml.

The molecular weight of the oxidized polyethylene wax preferably ranges from 2200 to 5200, more preferably from 2700 to 4700, and further more preferably from 3200 to 4200. An oxidized polyethylene wax having a molecular weight less than 2200 may result in poor lubricity of fabrics treated with the resultant fabric treating agent, and may cause poor sewability of the fabrics. On the other hand, an oxidized polyethylene wax having a molecular weight over 5200 may results in poor emulsifiability and stability of the resultant fabric treating agent, and may inhibit uniform application of the agent on fabrics. The oxidized polyethylene wax may comprise one or more of the oxidized polyethylene waxes mentioned above.

For optimizing the effect of the present invention (imparting good sewability to fabrics), the wax (a) employed in the present invention preferably comprises a paraffin wax (a1) having a melting point of 60° C. or higher, and a polyethylene wax (a2) having a melting point of 100° C. or higher and/or an oxidized polyethylene wax (a2) having a melting point of 100° C. or higher, wherein the weight ratio between the wax (a1) and the wax (a2) preferably ranges from 98:2 to 50:50. The fabric treating agent containing the wax (a1) and the wax (a2) in such weight ratio attains more excellent sewability of fabrics treated with the fabric treating agent. The weight ratio between the wax (a1) and the wax (a2) preferably ranges from 96:4 to 60:40, more preferably from 94:6 to 70:30, and further more preferably from 92:8 to 80:20. The ratio of the total of the wax (a1) and the wax (a2) in the wax (a) is preferably 80 wt % or more, more preferably 90 wt % or more, and further more preferably 100 wt %. A ratio less than 80 wt % may result in poor lubricity of fabrics treated with the fabric treating agent, and may cause poor sewability of the fabrics.

The wax (a) employed in the present invention preferably comprises a paraffin wax (a1) having a melting point of 60° C. or higher, and an oxidized paraffin wax (a3) having a melting point of 60° C. or higher, wherein the weight ratio between the component (a1) and the component (a3) preferably ranges from 98:2 to 80:20. A fabric treating agent comprising the component (a1) and component wax (a3) in a weight ratio within such range imparts more excellent sewability and improved friction fastness to fabrics. In addition, the wax (a) comprising the wax (a1) and the wax (a3) in a weight ratio within such range is dispersed in water to be made into a stable fabric treating agent which generates only a small amount of scum. The weight ratio between the component (a1) and the component (a3) preferably ranges from 96:4 to 82:18, more preferably from 94:6 to 85:15, and the most preferably from 92:8 to 87:13. The ratio of the total of the component (a1) and component (a3) to the wax (a) is preferably 80 wt % or more, more preferably 90 wt % or more, and further more preferably 100 wt %. A ratio of the waxes (a1) and (a3) to the wax (a) below 80 wt % may adversely affect on the lubricity of fabrics treated with the fabric treating agent to cause poor sewability of the fabrics.

The wax (a) in the fabric treating agent of the present invention may contain ester waxes other than those described above, for example, rice wax, candelilla wax, carnauba wax, bees wax, and montanic acid ester, so far as the effects of the present invention are not sacrificed. Those waxes should preferably have a melting point of 60° C. or higher.

The nonionic surfactant (b) is employed as the essential component of the fabric treating agent of the present invention as well as the wax (a). The nonionic surfactant (b) enables to make stable aqueous emulsion of the fabric treating agent, and contributes to excellent fogging preventability of the fabric treating agent. The nonionic surfactant (b) employed in the present invention is not specifically restricted, and may include polyoxyethylene alkyl ethers, polyoxyethylene alkylphenyl ethers, fatty acid glycerides, polyoxyethylene fatty acid esters, sorbitan fatty acid esters, polyoxyethylene sorbitan fatty acid esters, polyoxyethylene hydrogenated castor oils, polyoxyethylene-polyoxypropylene block copolymers, and the derivatives of the block copolymers.

The polyoxyethylene alkyl ethers include polyoxyethylene butyl ether, polyoxyethylene octyl ether, polyoxyethylene lauryl ether, polyoxyethylene cetyl ether, polyoxyethylene stearyl ether, polyoxyethylene oleyl ether, and polyoxyethylene behenyl ether. The mole number of added ethylene oxide preferably ranges from 1 to 60, and more preferably from 3 to 50. The carbon number of the alkyl groups in the polyoxyethylene alkyl ethers preferably ranges from 6 to 30, and more preferably from 12 to 24.

The polyoxyethylene alkylphenyl ethers include polyoxyethylene nonylphenyl ether, polyoxyethylene lauryl phenyl ether, polyoxyethylene styrenated phenyl ether, polyoxyethylene stearyl phenyl ether, and polyoxyethylene oleylphenyl ether. The mole number of added ethylene oxide should preferably range from 1 to 60, more preferably from 3 to 50. The carbon number of the alkyl groups in the polyoxyethylene alkylphenyl ethers should preferably range from 6 to 30, more preferably from 12 to 24.

The fatty acid glycerides include lauric acid monoglyceride, lauric acid diglyceride, oleic acid monoglyceride, oleic acid triglyceride, and palmitic acid diglyceride.

The polyoxyethylene fatty acid esters are produced by adding ethylene oxide to a fatty acid or by esterifying a fatty acid with polyethylene glycol. The polyoxyethylene fatty acid esters include polyethylene glycol lauric acid monoester, polyethylene glycol lauric acid diester, polyethylene glycol stearic acid monoester, and polyethylene glycol oleic acid diester. The mole number of added ethylene oxide preferably ranges from 1 to 60, and more preferably from 3 to 50. Preferable fatty acids are $C_6$-$C_{30}$ fatty acids, and more preferably $C_{12}$-$C_{24}$ fatty acids.

The sorbitan fatty acid esters include sorbitan monolaurate, sorbitan trilaurate, sorbitan dipalmitate, sorbitan monostearate, and sorbitan distearate.

The polyoxyethylene sorbitan fatty acid esters include polyoxyethylene sorbitan monolaurate, polyoxyethylene sorbitan trilaurate, polyoxyethylene sorbitan dipalmitate, polyoxyethylene sorbitan monostearate, and polyoxyethylene sorbitan distearate. The mole number of ethylene oxide added in a polyoxyethylene sorbitan fatty acid ester preferably ranges from 1 to 60, more preferably from 3 to 50.

The preferable polyoxyethylene hydrogenated castor oils are those containing 1 to 60 moles of ethylene oxide, and more preferably those containing 3 to 50 moles of ethylene oxide.

The polyoxyethylene-polyoxypropylene block copolymers and their derivatives include those containing ethylene oxide and propylene oxide in a weight ratio ranging from 20:80 to 80:20, preferably from 30:70 to 70:30. Their molecular weight should range from 1000 to 6000, and preferably from 2000 to 4000.

Among those nonionic surfactants, polyoxyethylene alkyl ethers and polyoxyethylene sorbitan fatty acid esters are preferable, and polyoxyethylene alkyl ethers are more preferable. The nonionic surfactant (b) may comprise one or more of the nonionic surfactants mentioned above.

The HLB of the nonionic surfactant (b) of the present invention is not specifically restricted. For improving the emulsifiability of the fabric treating agent during the emulsification of the wax (a) in water and for improving the stability of the fabric treating agent and its dilution, the HLB of the nonionic surfactant (b) should preferably range from 2.0 to 19.5, more preferably from 3.0 to 19.0, and further more preferably from 3.5 to 18.5. The HLB mentioned in the present invention is determined by Griffin's method.

The nonionic surfactant (b) of the present invention should preferably contain the nonionic surfactants (b1), (b2), and (b3) of different HLB as described below. The fabric treating agent containing the three nonionic surfactants of different HLB in the ratio described below imparts good sewability and friction fastness to fabrics. Those nonionic surfactants also contribute to improved emulsifiability and stability of the fabric treating agent, and make the fabric treating agent adhere on fabric surface uniformly.

(b1): a nonionic surfactant having HLB of from 1 to 7 (but excluding 7), constituting 2 to 40 wt % of the nonionic surfactant (b).

(b2): a nonionic surfactant having HLB of from 7 to 14 (but excluding 14), constituting 10 to 80 wt % of the nonionic surfactant (b).

(b3): a nonionic surfactant having HLB of from 14 to 20 (but excluding 20), constituting 2 to 40 wt % of the nonionic surfactant (b).

The nonionic surfactants (b1), (b2), and (b3) are those included in the nonionic surfactant (b), which are prepared by modifying hydrophilic groups, such as ethylene oxide, and hydrophobic groups, such as alkyl groups, so as to achieve the aforementioned respective HLB ranges.

The HLB of the nonionic surfactant (b1) should preferably be 1 to 7 (but excluding 7), and more preferably range from 3 to 6.7. The preferable nonionic surfactant (b1) includes fatty acid glycerides, sorbitan fatty acid esters, and polyoxyethylene alkyl ethers.

The fatty acid glycerides are the esters of fatty acids and glycerin, and may be any of monoesters, diesters, or triesters. The carbon number of the fatty acids forming the fatty acid glycerides should preferably range from 6 to 30, more preferably from 10 to 24, and further more preferably from 14 to 20. The fatty acids may be linear or branched, and linear fatty acids are preferable. In addition, the fatty acids may be saturated or unsaturated, and saturated fatty acids are preferable. The fatty acid glycerides include lauric acid monoglyceride, lauric acid diglyceride, oleic acid monoglyceride, oleic acid triglyceride, and palmitic acid diglyceride.

The sorbitan fatty acid esters are the esters of fatty acids and sorbitan, and may be any of monoesters, diesters, triesters, or tetraesters. The carbon number of the fatty acids forming the sorbitan fatty acid esters should preferably range from 6 to 30, more preferably from 10 to 24, and further more preferably from 14 to 20. The fatty acids may be linear or branched, and linear fatty acids are preferable. In addition, the fatty acids may be saturated or unsaturated, and saturated fatty acids are preferable. The sorbitan fatty acid esters include sorbitan monolaurate, sorbitan trilaurate, sorbitan dipalmitate, sorbitan monostearate, and sorbitan distearate.

The polyoxyethylene alkyl ethers are those mentioned in the description about the nonionic surfactant (b). The mole number of ethylene oxide added to the polyoxyethylene alkyl ethers should preferably range from 1 to 10, more preferably from 2 to 8, and further more preferably from 3 to 7. The carbon number of the alkyl groups in the polyoxyethylene alkyl ethers should preferably range from 6 to 30, more preferably from 10 to 27, and further more preferably from 12 to 24.

Among those surfactants, the fatty acid glycerides are preferable for the nonionic surfactant (b1), and fatty acid monostearate are further more preferable. The ratio of the nonionic surfactant (b1) in the nonionic surfactant (b) should preferably ranges from 5 to 40 weight percent, more preferably from 7 to 35 weight percent, and further more preferably from 10 to 30 weight percent, for making the fabric treating agent emulsifiable and stable. The nonionic surfactant (b1) may comprise one or more of the nonionic surfactants defined in the above description for the nonionic surfactant (b1).

The HLB of the nonionic surfactant (b2) should preferably be 7 to 14 (but excluding 14), and more preferably range from 11 to 13. The preferable nonionic surfactant (b2) includes polyoxyethylene alkyl ethers and polyoxyethylene fatty acid esters, and polyoxyethylene alkyl ethers are more preferable.

The polyoxyethylene alkyl ethers and polyoxyethylene fatty acid esters are those exemplified in the description about the nonionic surfactant (b). The mole number of ethylene oxide added in the polyoxyethylene alkyl ethers should preferably range from 3 to 30, more preferably from 5 to 15, and further more preferably from 7 to 13. The carbon number of the alkyl groups in the polyoxyethylene alkyl ethers should preferably range from 6 to 30, more preferably from 10 to 27, and further more preferably from 12 to 24. Among those ethers, polyoxyethylene stearyl ether is further preferable.

The ratio of the nonionic surfactant (b2) in the nonionic surfactant (b) should preferably range from 10 to 80 weight percent, more preferably from 3 to 75 weight percent, and further more preferably from 50 to 70 weight percent, for making the fabric treating agent emulsifiable and stable and for spreading the fabric treating agent uniformly on fabric surface. The nonionic surfactant (b2) may comprise one or more of the nonionic surfactants defined in the above description for the nonionic surfactant (b2).

The HLB of nonionic surfactant (b3) should preferably be 14 to 20 (but excluding 20), and more preferably ranges from 16 to 19. The preferable nonionic surfactant (b3) includes polyoxyethylene alkyl ethers and polyoxyethylene sorbitan esters, and polyoxyethylene alkyl ethers are more preferable.

The polyoxyethylene alkyl ethers and polyoxyethylene sorbitan esters are those exemplified in the description about the nonionic surfactant (b). The mole number of ethylene oxide added in the polyoxyethylene alkyl ethers should preferably range from 10 to 60, more preferably from 11 to 55, and further more preferably from 13 to 50. The carbon number of the alkyl groups in the polyoxyethylene alkyl ethers should preferably range from 6 to 30, more preferably from 10 to 27, and further more preferably from 12 to 24. The mole number of ethylene oxide added in the polyoxyethylene sorbitan esters should preferably range from 10 to 60, more preferably from 15 to 55, and further more preferably from 20 to 50. Among those compounds, polyoxyethylene oleyl ether is more preferable.

The ratio of the nonionic surfactant (b3) in the nonionic surfactant (b) should preferably range from 5 to 40 weight percent, more preferably from 7 to 35 weight percent, and further more preferably from 10 to 30 weight percent, for making the fabric treating agent emulsifiable and stable and for spreading the fabric treating agent uniformly on fabric surface. The nonionic surfactants (b3) may comprise one or more of the nonionic surfactants defined in the above description for the nonionic surfactant (b3).

The ratio of the wax (a) in the total of the wax (a) and the nonionic surfactant (b) should preferably range from 60 to 90 wt %, more preferably from 65 to 85 wt %, and further more preferably from 70 to 80 wt %. The ratio of those two essential components within the range makes the fabric treating agent emulsifiable and stable enough, and enables the agent to spread uniformly on fabric surface. In addition, the ratio also achieves good sewability, friction fastness, and fogging preventability of fabrics treated with the fabric treating agent. A ratio of the wax (a) less than 60 wt % may reduce the fastness, especially the friction fastness, of dyed fabric, because the ratio of the nonionic surfactant (b) relative to the ratio of the wax (a) becomes excessive. On the other hand, a ratio of the wax (a) over 90 wt % fails to make stable fabric treating agent by dispersing and emulsifying the wax (a) in water, and may cause difficulty in spreading the fabric treating agent uniformly on fabric surface.

The fabric treating agent of the present invention comprises the wax (a) and the nonionic surfactant (b) as essential components, and preferably comprises the anionic surfactant (c). The anionic surfactant (c) in the fabric treating agent improves the fastness, especially the friction fastness, of dyed fabric, and simultaneously retains good sewability of the treated fabric. In addition, the anionic surfactant (c) improves the emulsifiability of the wax (a) being dispersed and emulsified in water so as to make more stable fabric treating agent which generates less amount of scum. The ratio of the wax (a) in the total of the wax (a), the nonionic surfactant (b), and the anionic surfactant (c) should preferably range from 60 to 90 wt %, more preferably from 65 to 85 wt %, and further more preferably from 70 to 80 wt %. A ratio of the wax (a) less than 60 wt % may reduce the fastness, especially the friction fastness, of dyed fabric, because the ratio of the nonionic surfactant (b) and the anionic surfactant (c) becomes excessive. On the other hand, a ratio of the wax (a) over 90 wt % fails to make stable fabric treating agent by dispersing and emulsifying the wax (a) in water and may cause difficulty in spreading the fabric treating agent uniformly on fabric surface.

For adding the anionic surfactant (c) in the fabric treating agent, the weight ratio between the nonionic surfactant (b) and the anionic surfactant (c) should preferably range from 5:1 to 50:1, more preferable from 10:1 to 40:1, and further more preferably from 15:1 to 30:1. A weight ratio lower than 5:1 may deteriorate the lubricity and sewability of the fabric treated with the agent. On the other hand, a weight ratio over 50:1 may lower the ionic activity and repulsion of the particles of the wax (a) dispersed in water so as to fail to improve the emulsifiability of the fabric treating agent. Such weight ratio may also fail to improve the friction fastness of fabrics applied with the fabric treating agent.

The anionic surfactant (c) is not specifically restricted, and includes, for example, fatty acid salts such as sodium oleate, potassium palmitate, and triethanolamine oleate; alkyl sulfates such as sodium lauryl sulfate, ammonium lauryl sulfate, sodium stearyl sulfate, and sodium cetyl sulfate; salts of polyoxyethylene alkyl ether acetates such as sodium salt of polyoxyethylene tridecyl ether acetate; alkyl sulfonates; alkyl benzene sulfonates such as sodium dodecyl benzene sulfonate; polyoxyethylene alkyl ether sulfates; higher fatty acid amide sulfonates such as sodium stearoyl methyl taurate, sodium lauroyl methyl taurate, sodium myristoyl methyl taurate, and sodium palmitoyl methyl taurate; N-acyl sarcosinates, such as sodium lauroyl sarcosinate; alkyl phosphates, such as sodium monostearyl phosphate; polyoxyethylene alkyl ether phosphates, such as sodium salt of polyoxyethylene oleyl ether phosphate and sodium salt of polyoxyethylene stearyl ether phosphate; long-chain sulfosuccinates, such as sodium di-2-ethylhexyl sulfosuccinate and sodium dioctyl sulfosuccinate; long-chain N-acyl glutamates, such as monosodium N-lauroyl glutamate and disodium N-stearoyl-L-glutamate. The anionic surfactant (c) may comprise one or more of the anionic surfactants mentioned above.

Among those compounds included in the anionic surfactant (c), the compounds represented by the chemical formula (1) or (2) are preferable because of their performance to improve the emulsifiability and stability of the fabric treating agent and to impart good friction fastness to fabrics applied with the fabric treating agent.

In the chemical formula (1), $R^1$ is an alkyl group or alkylene group. The carbon number of $R^1$ should preferably range from 8 to 40, more preferably from 14 to 32, and further more preferably from 20 to 24, for achieving sufficient emulsifiability and stability of the fabric treating agent and spreading the fabric treating agent uniformly on fabrics. $M^1$ is a hydrogen atom, alkaline metal, alkaline earth metal, or a groups represented by $NR^3R^4R^5R^6$. $R^3$, $R^4$, $R^5$ and $R^6$ are each independently a hydrogen atom or an organic group. The organic group includes alkyl groups, alkylene groups, alkanol groups, and alkylphenol groups. The alkaline metal includes sodium, and potassium. The alkaline earth metal includes magnesium, calcium, and barium. The group represented by $NR^3R^4R^5R^6$ includes primary, secondary and tertiary alkylamines, cationic groups derived from alkanol amines, quaternary ammonium ion, and ammonium ion. The examples of those groups are monolauryl ammonium salt and distearyl ammonium salt. Among those substances for $M^1$, alkaline metals are preferable, and sodium and potassium are more preferable. The anionic surfactant represented by the chemical formula (1) may comprise one or more of the anionic surfactants represented by the chemical formula (1).

The anionic surfactant represented by the chemical formula (1) includes sodium lauryl sulfate, potassium lauryl sulfate, sodium octyl sulfate, potassium octyl sulfate, sodium myristyl sulfate, potassium myristyl sulfate, sodium cetyl sulfate, potassium cetyl sulfate, sodium stearyl sulfate, potassium stearyl sulfate, sodium oleyl sulfate, potassium oleyl sulfate, sodium $C_{18}$-$C_{24}$ rapeseed oil sulfate, potassium $C_{18}$-$C_{24}$ rapeseed oil sulfate, sodium $C_{14}$-$C_{20}$ soybean oil sulfate, and potassium $C_{14}$-$C_{20}$ soybean oil sulfate.

In the chemical formula (2), $R^1$ represents an organic group having a carbon number ranging from 8 to 40. The examples of the organic group include alkyl groups, alkylene groups, phenyl groups, and alkyl phenyl groups having alkyl groups. Among those groups, alkyl phenyl groups having $C_8$-$C_{34}$ (preferably $C_{20}$-$C_{24}$ alkyl groups are more preferable. $M^2$ includes the same substances as those aforementioned for $M^1$. Among those substances, alkaline metals are preferable, and sodium and potassium are more preferable. The anionic surfactant represented by the chemical formula (2) may comprise one or more of the anionic surfactants represented by the chemical formula (2).

The anionic surfactant represented by the chemical formula (2) includes potassium dodecylbenzene sulfonate, sodium dodecylbenzene sulfonate, sodium octylphenol sulfonate, and potassium octyl sulfosuccinate.

The fabric treating agent of the present invention may contain a cationic surfactant such as alkyl ammonium chloride, alkylbenzyl ammonium chloride, and polyoxyethylene alkylamine, in an amount that does not deteriorate the effects of the present invention. However, the fabric treating agent which does not substantially contain a cationic surfactant is preferable, because cationic surfactants may sometimes deteriorate the friction fastness of fabrics. The ratio of the cationic surfactant to the total of the wax (a) and the nonionic surfactant (b) or the total of the wax (a), the nonionic surfactant (b), and the anionic surfactant (c) should preferably be 4 wt % or less, more preferably 2 wt % or less, further more preferably 1.5 wt % or less, and most preferably 0 wt %.

For stabilizing the fabric treating agent of the present invention, antifreezing agents, such as ethylene glycol, propylene glycol, and glycerin; antifoam agents, such as silicones and mineral oils; viscosity improvers, such as methanol, ethanol, propyl alcohol, butyl glycol, and ethyl glycol; pH controllers, such as formic acid, acetic acid, propionic acid, butyric acid, lactic acid, phosphoric acid, chloric acid, sulfuric acid, sodium hydroxide, potassium hydroxide, and ammonia water; reducing agents, such as sodium bisulfite and sodium hypochlorite; mildewcides; and antiseptics may be added in an amount that does not deteriorate the effects of the present invention.

The fabric treating agent of the present invention should preferably be used in a form in which the wax (a) is in a state of an oil-in-water dispersion. The fabric treating agent of the present invention may be produced in several processes, for example, emulsifying the wax (a) into oil-in-water emulsion with the nonionic surfactant (b) or with the combination of the nonionic surfactant (b) and the anionic surfactant (c); and dispersing the wax (a), which is previously pulverized in dry or wet state, into oil-in-water suspension with the nonionic surfactant (b) or with the combination of the nonionic surfactant (b) and the anionic surfactant (c). The process for producing the fabric treating agent by emulsifying the wax (a) is preferable for stabilizing the fabric treating agent.

As mentioned above, the wax (a) should preferably be a mixture of the component (a1) and the component (a2) or a mixture of the component (a1) and the component (a3) for stabilizing the fabric treating agent, and a mixture of the component (a1) and the component (a3) is especially preferable. For better stabilization of the fabric treating agent, the wax (a) in the form of a mixture should be completely melted above its melting point before being emulsified into oil-in-water emulsion.

An example of the process for producing the fabric treating agent of the present invention is carried out as follows. A paraffin wax, polyethylene wax, a surfactant, a reducing agent, and water are charged in a 2-liter stainless steel autoclave, and then the autoclave is tightly closed and purged with nitrogen gas to completely remove the air in the system. Then the ingredients in the autoclave are heated up to a predetermined temperature, and is agitated at high speed with a spiral agitator or homogenizer to be emulsified through phase-conversion emulsification. Then the resultant emulsion is cooled down to room temperature, and then a predetermined amount of water, an antiseptic, a mildewcide, a pH controller, an antifoaming agent, and a viscosity improver are added to the emulsion. The phase-conversion emulsification should be carried out at 100° C. or higher temperature. The ingredients should be pressurized with nitrogen gas of 0.1 to 0.4 MPa during the phase-conversion emulsification for the purpose of stabilizing the emulsion and its dilution for fabric treatment.

For making the wax (a) into oil-in-water emulsion, the preferable concentration of the solids in the emulsion ranges from 10 to 50 wt %, more preferably from 15 to 45 wt %, and further more preferably from 18 to 38 wt % in order to achieve a desirable emulsifiability and stability of the fabric treating agent and to spread the fabric treating agent uniformly on fabrics. The word, "solids" mean the total of the wax (a), the nonionic surfactant (b), and the anionic surfactant (c).

The average particle size of the wax (a) being in a state of an oil-in-water dispersion should preferably range from 0.05 to 100 μm, more preferably from 0.05 to 50 μm, and further more preferably from 0.05 to 10 μm for stabilizing the particles and spreading the fabric treating agent uniformly on fabrics. The average particle size is determined with a particle size analyzer LA-910 (manufactured by Horiba Ltd.).

The process for producing the fabric of the present invention utilizes the techniques for treating fabrics, such as a dipping method, an impregnating method, a pad-dry method, spraying or coating, with the fabric treating agent of the present invention. Among those techniques, pad-dry method is the most preferable for its high productivity and economy. The fabric treating agent may be applied in the form as prepared by emulsifying the wax (a) into oil-in-water emulsion, and also in the form of weak solution prepared by diluting the emulsion with water. The fabric treating agent may optionally contain an antioxidant, ultraviolet absorber, antifoaming agent, antiseptic, mildewcide, pH controller, and chelating agent. The fabric treating agent should preferably be applied to woven or knitted fabrics after dyeing. A fabric treated with the fabric treating agent should not be fed to dyeing, because the agent is removed from the fabric in dyeing operation.

The concentration of the solids in the fabric treating agent and its dilution should preferably range from 0.1 to 30 wt %, more preferably from 0.2 to 8 wt %, and further more preferably from 0.3 to 6 wt %. A concentration of the solids less than 0.1 wt % may result in poor sewability of a fabric treated with the fabric treating agent because of low amount of the solids on the fabric. On the other hand, a concentration of the solids over 30 wt % may deteriorate the friction fastness of a fabric treated with the fabric treating agent because of excessive amount of the solids on the fabric. The word "solids" means the total of the wax (a), nonionic surfactant (b), and anionic surfactant (c). The temperature of the fabric treating agent and its dilution for fabric treatment should preferably range from 10 to 80° C., more preferably from 20 to 50° C., and further more preferably from 20 to 40° C. A temperature below 10° C. may cause poor sewability of the treated fabric because of insufficient amount of the solids on the fabric. On the other hand, a temperature over 80° C. accelerates water evaporation from the fabric treating agent and its dilution to change the concentration of the solids in the agent and its dilution during treatment operation so as to inhibit uniform application of the fabric treating agent and its dilution.

The amount of the solids of the fabric treating agent on fabric material should preferably range from 0.01 to 20 wt %, more preferably from 0.05 to 8 wt %, and further more preferably from 0.1 to 5 wt %. An amount of less than 0.01 wt % may not attain sufficient sewability while an amount over 20 wt % may deteriorate the fastness, especially the friction fastness, of a dyed fabric.

The vehicle interior material fabrics of the present invention include tricot, moquette, circular knit fabric, double raschel knit fabric, woven fabric, artificial leather, and nonwoven fabric, which are employed for car seat (upholstery), and also include fabrics imparted with several performances, such as light resistance, antistaticity, and stain resistance. Fabrics employed for vehicle upholsteries include moquette, plain weave fabric, knit fabric, and fabrics of the blends or mixed weave of polyester fiber and flame-retardant or heat-resistant fiber.

The preferable fabric materials to be treated with the fabric treating agent of the present invention are vehicle interior materials for automobiles and trains, especially fabrics for automotive interior materials. Those fabric materials include fabrics of polyester fiber, nylon fiber, acrylic fiber, acetate fiber, and rayon fiber. Above all fabrics of polyester fiber and fabrics of the blends or mixed weave or knit of polyester fiber and one or more of fiber variants are preferable. The polyester fiber includes cationic-dyeable polyester (CDP), polybutylene terephthalate (PBT), and polytrimethylene terephthalate (PTT), in addition to polyethylene terephthalate (PET). The fabrics include woven or knit fabrics and nonwoven fabrics of ultrafine fiber blends, and mixed weave or knit of ultrafine fiber and other fiber. Here, ultrafine fiber means fiber of 1 dtx or finer. The fabric treating agent of the present invention is preferable for treating fabric materials of ultrafine fiber.

EXAMPLE

The present invention is described specifically with the following examples and comparative examples, though the present invention is not restricted within the scope of those examples.

Example 1

In a 2-liter stainless steel autoclave equipped with a high-speed homogenizer, 240 g of a paraffin wax (melting point 60° C.) (the wax (a)), 10 g of stearic acid monoglyceride, 20 g of polyoxyethylene (10) oleyl ether (hereinafter referred to as POE (10) oleyl ether) (as the nonionic surfactant (b)), and 30 g of POE (20) stearyl ether (as the nonionic surfactant (b)) were charged. The air in the autoclave was completely replaced with nitrogen gas through consecutive steps of pressurizing with nitrogen gas to 0.3 MPa and opening the autoclave which were carried out three times. Then the ingredients were heated up to 150° C. with high-speed agitation with the high-speed homogenizer, and further agitated at 150° C. for 1 hour. Then from another stainless steel autoclave set above the autoclave containing the ingredients, 697 g of hot water heated at 150° C. was dropped into the ingredients over 2 hours to emulsify the ingredients through phase-conversion emulsification. After dropping all of the hot water, the emulsion was aged at 150° C. for 1 hour and cooled down to 80° C. Then the autoclave was opened to decrease its internal pressure to normal pressure, and the emulsion was cooled down to 40° C. Then 2 g of glycerin, 0.5 g of SILICONE KM-92 (an antifoaming agent manufactured by Shin-Etsu Chemical Co., Ltd.), and 0.5 g of ACTICIDE MV4 (an antiseptic manufactured by Thor Japan Ltd.) were added to the emulsion to make a fabric treating agent in the form of a bluish white aqueous emulsion.

Examples 2 to 4

Fabric treating agents in the form of an aqueous emulsion were prepared in the same manner as in Example 1 except that the wax (a) and the nonionic surfactant (b) in Example 1 were replaced with the waxes (a) and the nonionic surfactants (b) with the ratios shown in Table 1.

Example 5

In a 2-liter stainless steel autoclave equipped with a high-speed homogenizer, 200 g of a oxidized polyethylene wax (melting point 138° C., acid value 30, as the wax (a)), 30 g of POE (8) oleyl ether (as the nonionic surfactant (b)), 70 g of POE (20) oleyl ether (as the nonionic surfactant (b)), 6 g of potassium hydroxide, and 0.8 g of sodium bisulfite were charged. The air in the autoclave was completely replaced with nitrogen gas through consecutive steps of pressurizing with nitrogen gas to 0.3 MPa and opening the autoclave which were carried out three times. Then the ingredients were heated up to 150° C. with high-speed agitation with the high-speed homogenizer, and further agitated at 150° C. for 1 hour. Then from another stainless steel autoclave set above the autoclave containing the ingredients, 690.2 g of hot water heated at 150° C. was dropped into the ingredients over 2 hours to emulsify the ingredients through phase-conversion emulsification. After dropping all of the hot water, the emulsion was aged at 150° C. for 1 hour and cooled down to 80° C. Then the autoclave was opened to decrease its internal pressure to normal pressure, and the emulsion was cooled down to 40° C. Then 2 g of glycerin, 0.5 g of SILICONE KM-92 (an antifoaming agent manufactured by Shin-Etsu Chemical Co., Ltd.), and 0.5 g of ACTICIDE MV4 (an antiseptic manufactured by Thor Japan Ltd.) were added to the emulsion to make a fabric treating agent in the form of a pale yellow transparent aqueous emulsion.

Examples 6 to 10

Fabric treating agents in the form of aqueous emulsion were prepared in the same manner as in Example 5 except that the wax (a) and the nonionic surfactant (b) in Example 5 were replaced with the waxes (a) and the nonionic surfactants (b) with the ratios shown in Table 1.

TABLE 1

| Example | Wax (a) (parts by weight) | Nonionic surfactant (b) (parts by weight) |
|---|---|---|
| 1 | Paraffin wax (melting point 66° C.) (24 parts) | Stearic acid monoglyceride (HLB 3.4) (1 part)<br>POE(10) oleyl ether (HLB 12.4) (2 parts)<br>POE(20) stearyl ether (HLB 15.3) (3 parts) |
| 2 | Paraffin wax (melting point 69° C.) (24 parts) | Stearic acid monoglyceride (HLB 3.4) (2 parts)<br>POE(10) oleyl ether (HLB 12.4) (2 parts)<br>POE(20) stearyl ether (HLB 15.3) (2 parts) |
| 3 | Paraffin wax (melting point 78° C.) (24 parts) | Stearic acid monoglyceride (HLB 4.9) (2 parts)<br>POE(15) lauryl ether (HLB 15.6) (1 part)<br>POE(10) oleyl ether (HLB 12.4) (3 parts) |
| 4 | Paraffin wax (melting point 107° C.) (24 parts) | Lauric acid monoglyceride (HLB 4.5) (2 parts)<br>POE(15) lauryl ether (HLB 15.6) (1.5 parts)<br>POE(25) lauryl ether (HLB 17.1) (2.5 parts) |
| 5 | Oxidized polyethylene wax (melting point 138° C., acid value 30) (20 parts) | POE(8) oleyl ether (HLB 11.4) (3 parts)<br>POE(20) oleyl ether (HLB 15.3) (7 parts) |
| 6 | Polyethylene wax (melting point 130° C.) (20 parts) | POE(15) oleyl ether (HLB 14.2) (4 parts)<br>POE(30) oleyl ether (HLB 16.6) (6 parts) |
| 7 | Paraffin wax (melting point 107° C.) (16 parts)<br>Oxidized polyethylene wax (melting point 138° C., acid value 30) (4 parts) | POE(8) oleyl ether (HLB 11.4) (1 part)<br>POE(15) stearyl aminoether (HLB 13.7) (3 parts)<br>POE(20) oleyl ether (HLB 15.3) (6 parts) |
| 8 | Paraffin wax (melting point 107° C.) (16 parts)<br>Oxidized polyethylene wax (melting point 138° C., acid value 30) (2 parts)<br>Polyethylene wax (melting point 130° C.) (2 parts) | POE(8) oleyl ether (HLB 11.4) (1 part)<br>POE(15) stearyl aminoether (HLB 13.7) (4 parts)<br>POE(20) oleyl ether (HLB 15.3) (5 parts) |
| 9 | Oxidized polyethylene wax (melting point 102° C., acid value 15) (20 parts) | POE(7) lauryl ether (HLB 12.5) (2 parts)<br>POE(25) oleyl ether (HLB 16.1) (8 parts) |
| 10 | Paraffin wax (melting point 60° C.) (24 parts) | Sorbitan distearate (HLB 3.7) (3 parts)<br>POE(20) sorbitan tristearate(HLB 11.0) (3 parts) |

Comparative Example 1

In a 1.5-liter stainless steel mixing tank equipped with a thermometer, 240 g of a paraffin wax (melting point 58° C., a wax), 20 g of POE (10) lauryl ether (a nonionic surfactant), and 40 g of POE (30) oleyl ether (a nonionic surfactant) were charged and heated to 90° C. to be melted completely. Then 697 g of water was gradually added to the melted ingredients with heating at 90 to 95° C. and agitation so as to emulsify the ingredients through phase-conversion emulsification. After adding all of the water, the mixture was aged at 90 to 93° C. with agitation for 1 hour, and then cooled down to 40° C. Then 2 g of glycerin, 0.5 g of SILICONE KM-92 (an antifoaming agent manufactured by Shin-Etsu Chemical Co., Ltd.), 0.5 g of ACTICIDE Mv4 (an antiseptic manufactured by Thor Japan Ltd.) were added to make a fabric treating agent in the form of bluish white aqueous emulsion.

Comparative Examples 2-7

Fabric treating agents in the form of aqueous emulsion were produced in the same manner as in Comparative example 1 except that the wax and nonionic surfactants in Comparative example 1 were replaced with the waxes and nonionic surfactants with the ratios in Table 2.

TABLE 2

| Comparative example | Wax (parts by weight) | Nonionic surfactant (parts by weight) |
|---|---|---|
| 1 | Paraffin wax (melting point 58° C.) (24 parts) | POE(10) lauryl ether (HLB 14.1) (2 parts)<br>POE(30) oleyl ether (HLB 16.6) (4 parts) |
| 2 | Paraffin wax (melting point 53° C.) (24 parts) | POE(7) lauryl ether (HLB 12.5) (3 parts)<br>POE(20) stearyl ether (HLB 15.3) (3 parts) |
| 3 | Oxidized polyethylene wax (melting point 88° C., acid value 15) (24 parts) | POE(8) oleyl ether (HLB 11.4) (3 parts)<br>POE(15) oleyl ether (HLB 14.2) (3 parts) |
| 4 | Polyethylene wax (melting point 70° C.) (24 parts) | POE(15) oleyl aminoether (HLB 13.7) (2 parts)<br>POE(15) stearyl ether (HLB 14.2) (3 parts)<br>POE(18) styrenated phenyl ether (HLB 17.4) (1 part) |
| 5 | Paraffin wax (melting point 53° C.) (15 parts)<br>Oxidized polyethylene wax (melting point 88° C., acid value 15) (9 parts) | POE(8) oleyl ether (HLB 11.4) (1 part)<br>POE(15) oleyl ether (HLB 14.2) (2 parts)<br>POE(50) lauryl ether (HLB 18.4) (3 parts) |

TABLE 2-continued

| Comparative example | Wax (parts by weight) | Nonionic surfactant (parts by weight) |
|---|---|---|
| 6 | Paraffin wax (melting point 53° C.) (12 parts)<br>Oxidized polyethylene wax (melting point 88° C., acid value 15) (8 parts)<br>Polyethylene wax (melting point 70° C.) (4 parts) | POE(10) stearyl aminoether (HLB 11.9) (2 parts)<br>POE(20) stearyl ether (HLB 15.3) (2 parts)<br>POE(18) styrenated phenyl ether (HLB 17.4) (1 part)<br>Polyethylene glycol (M.W. 600) laurate (HLB 14.8) (1 part) |
| 7 | Paraffin wax (melting point 50° C.) (20 parts)<br>Oxidized polyethylene wax (melting point 68° C., acid value 30) (4 parts) | POE(8) oleyl ether (HLB 11.4) (2 parts)<br>POE(15) oleyl ether (HLB 14.2) (2 parts)<br>POE(20) sorbitan stearate(HLB 15.7) (2 parts) |

The fabric treating agents produced in Examples 1 to 10 and Comparative examples 1 to 7 were tested in the following methods.

Treatment

Each of the fabric treating agents was diluted with water to contain 2.5 wt % of solids, and applied to the fabric samples A and B by pad-dry under the following condition.

Fabric sample A: polyester tropical fabric, woven fabric of 120 ends (160 dtex72f each)/inch×51 picks (320 dtex48f each)/inch Fabric sample B: polyester tricot, knit fabric of textured polyester yarn (0.9 dtex per filament) with 35 wales/inch, 56 coursewise ribs/inch, 1960 loops/inch$^2$, and the density of 150 g/m$^2$ Treatment bath: aqueous emulsion of a fabric treating agent containing 2.5 wt % of solids Padding: at room temperature, with "double dip, double nip" technique, 80% wet-pickup for the fabric sample A, 77% wet-pickup for the fabric sample B Drying: at 110° C. for 2 minutes The polyester fabric samples treated as mentioned above were tested in the following methods.

Sewability

Four sheets of each fabric sample were layered and sewn with an industrial sewing machine (B770, manufactured by Brother Industries, Ltd.) attached with a 11J sewing needle at the sewing speed of 5000 rpm to make 600 stitches per 200 cm seam. Then 600 stitches of the seam was inspected to count fabric yarn cut in the sewing operation. The test was carried out 5 times, and the average number of the fabric yarn cut was calculated into the sewability (%) by the following equation:

Sewability (%)=Number of cut fabric yarn/600 (number of stitches)×100.

Lower percentage indicates better sewability, and the fabrics applied with the treating agent of the present invention resulted in 13% or less, while the preferable sewability is 8% or less.

Lubricity

Ten examiners including both men and women manually inspected the lubricity of each of the treated fabric samples, and classified the lubricity into four grades: A excellent, B good, C a little poor, D poor.

Fogging Preventability

Ten grams of a treated fabric sample was placed in a 1-liter glass container, and lid with a 5-mm thick 5-cm square glass plate. Then the glass container was immersed in oil bath at 100° C. to 10 cm or more above the bottom of the glass container for 10 hours. Then the glass plate was taken off and excessive moisture was evaporated with a drier. The reflectance of the glass plate (reflectance at 60 degrees incident angle) was measured with a reflectometer (manufactured by Suga Test Industries Co., Ltd.) as R1, and the reflectance of an un-treated glass plate as a blank was measured as R0. Both of the results were calculated into fogging (%) by the following equation: Fogging (%)=R1/R0×100. The test were conducted five times for each of the treated fabric samples, and the average of the five tests was calculated as the Fogging of the sample. Higher vale of the "Fogging" indicates better fogging preventability of the treated fabric.

The results of the testings are shown in Table 3. The results show that the fabric treating agent of the present invention imparts excellent sewability, lubricity, and fogging preventability to the treated fabrics. As proved here, the fabric treating agent of the present invention provides vehicle interior materials for automobiles and trains having better sewability, lubricity, and fogging preventability than those attained by conventional treating agents. The fabrics treated with the agent exhibit high processing efficiency in sewing operation to be sewn into articles with high quality seam, and have greatly improved performance to prevent fogging, which is one of the troubles found on interior materials for automobiles. Thus the fabric treating agent provides high quality interior materials for vehicles including automobiles and trains.

TABLE 3

| | | Fabric sample A | | | Fabric sample B | | |
|---|---|---|---|---|---|---|---|
| | Test No. | Sewability (%) | Lubricity | Fogging (%) | Sewability (%) | Lubricity | Fogging (%) |
| Examples | 1 | 3.3 | B | 93.3 | 8.0 | B | 89.4 |
| | 2 | 3.5 | A | 89.6 | 7.8 | B | 88.6 |
| | 3 | 1.2 | A | 93.0 | 1.5 | A | 91.4 |
| | 4 | 0.0 | B | 98.2 | 1.7 | B | 95.2 |
| | 5 | 2.8 | B | 88.4 | 2.5 | B | 87.9 |
| | 6 | 3.1 | A | 89.1 | 2.1 | A | 88.3 |
| | 7 | 1.9 | A | 98.8 | 1.7 | B | 91.5 |
| | 8 | 0.0 | A | 97.2 | 0.8 | A | 93.8 |
| | 9 | 3.3 | B | 89.8 | 3.8 | B | 88.5 |
| | 10 | 8.7 | B | 77.3 | 11.9 | B | 67.3 |

TABLE 3-continued

| Test No. | | Fabric sample A | | | Fabric sample B | | |
|---|---|---|---|---|---|---|---|
| | | Sewability (%) | Lubricity | Fogging (%) | Sewability (%) | Lubricity | Fogging (%) |
| Comparative examples | 1 | 15.2 | B | 66.7 | 21.5 | D | 44.5 |
| | 2 | 18.6 | D | 71.4 | 27.3 | C | 39.8 |
| | 3 | 23.1 | B | 71.9 | 24.5 | B | 53.2 |
| | 4 | 29.2 | B | 58.4 | 22.6 | B | 47.8 |
| | 5 | 19.4 | C | 55.6 | 17.5 | C | 43.6 |
| | 6 | 24.9 | C | 48.4 | 29.3 | C | 10.5 |
| | 7 | 20.8 | B | 59.0 | 30.7 | D | 19.8 |

Example 11

In a 2-liter stainless steel autoclave equipped with a high-speed homogenizer, 240 g of a paraffin wax (melting point 66° C., as the wax (a)), 60 g of POE (10) behenyl ether (as the nonionic surfactant (b)), and 4 g of sodium stearyl sulfate (as the anionic surfactant (c)) were charged. The air in the autoclave was completely replaced with nitrogen gas through consecutive steps of pressurizing with nitrogen gas to 0.3 MPa and opening which were carried out three times. Then the ingredients were heated up to 150° C. with high-speed agitation with the high-speed homogenizer, and further agitated at 150° C. for 1 hour. Then from another stainless steel autoclave set above the autoclave containing the ingredients, 693 g of hot water heated at 150° C. was dropped into the ingredients over 2 hours to emulsify the ingredients through phase-conversion emulsification. After dropping all of the hot water, the emulsion was aged at 150° C. for 1 hour and cooled down to 80° C. Then the autoclave was opened to decrease its internal pressure to normal pressure, and the emulsion was cooled down to 40° C. Then 2 g of glycerin, 0.5 g of SILICONE KM-92 (an antifoaming agent manufactured by Shin-Etsu Chemical Co., Ltd.), and 0.5 g of ACTICIDE MV4 (an antiseptic manufactured by Thor Japan Ltd.) were added to the emulsion to make a fabric treating agent in the form of a bluish white aqueous emulsion.

Examples 12 to 26

Fabric treating agents in the form of aqueous emulsion were produced in the same manner as in Example 11 except that the wax (a), the nonionic surfactant (b), and the anionic surfactant (c) in Example 11 were replaced with the wax (a), the nonionic surfactant (b), and the anionic surfactant (c) with the ratios shown in Tables 4 and 5.

The fabric treating agents produced in Examples 11 to 26 were tested in the following methods.

Treatment

Each of the fabric treating agents was diluted with water to contain 2.5 wt % of solids, and applied to the fabric sample A by pad-dry under the same condition as that for the fabric treating agents in Examples 1 to 10 and Comparative examples 1 to 7.

The polyester fabric samples treated as mentioned above were tested in the following methods.

Sewability

The sewability of the fabric samples was tested in the aforementioned testing method.

Friction Fastness

The polyester fabric samples (the fabric sample A, black colored) treated in the above mentioned treatment method were cut in rectangles of 22 cm long and 3 cm wide, and one test piece from each of the fabric samples was prepared for each of the dry friction fastness and wet friction fastness tests. A 6-cm square piece of dry white cotton fabric was set at the top of a friction part of a color fastness rubbing tester II (designed by Japan Society for the Promotion of Science) for dry friction test. Then the friction part was rubbed on the test piece lengthwise to and fro in the distance of 10 cm ten cycles in 10 seconds (dry friction test). The color of the rubbed white cotton fabric was measured with a calorimeter CR-400 (manufactured by Konica Minolta Sensing, Inc.), and the grade of the measured color was read on the gray scale of the calorimeter. The gray scale is classified into five grades from 1 to 5, and higher number indicates better friction fastness. The wet friction test was conducted in the same manner as that for the dry friction test except that the white cotton fabric was wet with water.

Emulsifiability

Each 500 ml of the fabric treating agents in Examples 11 to 26 was filtered through black filter paper (manufactured by Advantec Toyo Kaisha Ltd., Toyo Qualitative Paper No. 131, 90 mm in diameter), and the amount of scum remained on the filter paper was visually inspected. A fabric treating agent having poor emulsifiability and stability contains greater amount of non-emulsified wax (a), and leaves more scum on the filter paper. The preferable amount of the scum is 80% or less, being represented by the percentage of the area of the filter paper where the scum remains, more preferably 50% or less, further more preferably 10% or less, and most preferably no scum on the filter paper. An amount of scum remaining on 80% or more area of the filter paper indicates excessive amount of non-emulsified wax (a) in the fabric treating agent which may cause nonuniform spreading of the fabric treating agent on fabric.

A: 10% or less of the area on black filter paper holding scum

B1: from more than 10 to 50% of the area on black filter paper holding scum

B2: from more than 50 to 80% of the area on black filter paper holding scum

The results of the testings are shown in Tables 4 and 5. The results in Tables 4 and 5 show that the fabric treating agent of the present invention imparts excellent sewability. The fabric treating agent containing the waxes (a1) and (a3), and the fabric treating agent further containing the nonionic surfactants (b1), (b2), and (b3) or containing the anionic surfactant (c) exhibit good emulsifiability and impart excellent friction fastness to fabrics in addition to imparting excellent sewability to fabrics. As described here, the fabric treating agent of the present invention provides vehicle interior materials for automobiles and trains having better sewability, lubricity, and fogging preventability than those attained by conventional treating agents. The fabrics treated with the agent exhibits high processing efficiently in sewing operation to be sewn into articles with high quality seam, and have greatly improved performance to prevent fogging, which is one of the troubles found on interior materials for automobiles. Thus the fabric treating agent provides vehicle interior materials with higher quality.

TABLE 4

| | | | | Example | | | | | | | |
|---|---|---|---|---|---|---|---|---|---|---|---|
| | | | | 11 | 12 | 13 | 14 | 15 | 16 | 17 | 18 |
| Wax (a) | (a1) | Paraffin wax (melting point 66° C.) | | 240 | 227 | 227 | 227 | 227 | 225 | 170 | 255 |
| | | Paraffin wax (melting point 72° C.) | | | | | | | | | |
| | | Paraffin wax (melting point 76° C.) | | | | | | | | | |
| | (a2) | Polyethylene wax (melting point 138° C.) | | | | | | | | | |
| | (a3) | Oxidized paraffin wax (melting point 75° C., acid value 15) | | | 13 | 13 | 13 | 13 | 15 | 10 | 15 |
| | | Oxidized paraffin wax (melting point 78° C., acid value 20) | | | | | | | | | |
| | | Oxidized paraffin wax (melting point 82° C., acid value 18) | | | | | | | | | |
| Nonionic surfactant (b) | (b1) | Sorbitan monostearate | HLB 6.4 | | 12 | | 12 | 12 | | 23 | 7 |
| | | Sorbitan trilaurate | HLB 3.0 | | | | | | 9 | | |
| | | POE(3)stearyl ether | HLB 6.6 | | | | | | | | |
| | (b2) | POE(10) behenyl ether | HLB 11.5 | 60 | | 38 | | | | 69 | 18 |
| | | POE(10)stearyl ether | HLB 12.4 | | 38 | | 38 | 38 | | | |
| | | POE(7) lauryl ether | HLB 12.5 | | | | | | 41 | | |
| | (b3) | POE(20) lauryl ether | HLB 16.5 | | | | | | 10 | | |
| | | POE(30) oleyl ether | HLB 16.6 | | 10 | 22 | 1 | 10 | | 28 | 5 |
| | | POE(50) cetyl ether | HLB 18.1 | | | | | | | | |
| anionic surfactant (c) | Potassium stearyl sulfate | | | | | | | 2 | 2 | | |
| | Sodium stearyl sulfate | | | 4 | | 3 | | | | 3 | 8 |
| | Sodium dodecylbenzene sulfonate | | | | | | | | | | |
| | POE(5) tridecyl phosphate | | | | | | 4 | | | | |
| Others | Glycerin | | | 2 | 2 | 2 | 2 | 2 | 2 | 2 | 2 |
| | Silicone KM-92 | | | 0.5 | 0.5 | 0.5 | 0.5 | 0.5 | 0.5 | 0.5 | 0.5 |
| | Antiseptic | | | 0.5 | 0.5 | 0.5 | 0.5 | 0.5 | 0.5 | 0.5 | 0.5 |
| | Water | | | 693 | 697 | 694 | 693 | 695 | 695 | 694 | 689 |
| Total | | | | 1000 | 1000 | 1000 | 1000 | 1000 | 1000 | 1000 | 1000 |
| Sewability | | | | 2.1 | 1.7 | 2.9 | 1.9 | 3.2 | 2.5 | 8.4 | 0.3 |
| Friction fastness | | Dry | | 3 | 3 | 3 | 3 | 3 | 3 to 4 | 2 | 4 |
| | | Wet | | 3 to 4 | 2 to 3 | 3 to 4 | 3 | 3 | 3 | 1 to 2 | 4 |
| Emulsifiability | | | | B1 | B1 | B2 | B2 | A | A | A | B2 |

TABLE 5

| | | | Example | | | | | | | |
|---|---|---|---|---|---|---|---|---|---|---|
| | | | 19 | 20 | 21 | 22 | 23 | 24 | 25 | 26 |
| Wax (a) | (a1) | Paraffin wax (melting point 66° C.) | 227 | 190 | 227 | 227 | | | 227 | 227 |
| | | Paraffin wax (melting point 72° C.) | | | | | 227 | | | |
| | | Paraffin wax (melting point 76° C.) | | | | | | 227 | | |
| | (a2) | Polyethylene wax (melting point 138° C.) | | 50 | | | | | | |
| | (a3) | Oxidized paraffin wax (melting point 75° C., acid value 15) | 13 | | 13 | 13 | 13 | 13 | | |
| | | Oxidized paraffin wax (melting point 78° C., acid value 20) | | | | | | | 13 | |
| | | Oxidized paraffin wax (melting point 82° C., acid value 18) | | | | | | | | 13 |

TABLE 5-continued

| | | | | Example | | | | | | | |
|---|---|---|---|---|---|---|---|---|---|---|---|
| | | | | 19 | 20 | 21 | 22 | 23 | 24 | 25 | 26 |
| Nonionic surfactant (b) | (b1) | Sorbitan monostearate | HLB 6.4 | 12 | | 25 | 12 | 14 | | | |
| | | Sorbitan trilaurate | HLB 3.0 | | | | | | 11 | 12 | |
| | | POE(3) stearyl ether | HLB 6.6 | | 11 | | | | | | 13 |
| | (b2) | POE(10) behenyl ether | HLB 11.5 | | | | | | 39 | | 39 |
| | | POE(10) stearyl ether | HLB 12.4 | 38 | | 10 | 38 | 36 | | 38 | |
| | | POE(7) lauryl ether | HLB 12.5 | | 32 | | | | | | |
| | (b3) | POE(20) lauryl ether | HLB 16.5 | | | 25 | | | | 10 | |
| | | POE(30) oleyl ether | HLB 16.6 | 10 | | | 10 | | 10 | | 8 |
| | | POE(50) cetyl ether | HLB 18.1 | | 17 | | | 10 | | | |
| Anionic surfactant (c) | Potassium stearyl sulfate | | | | 2 | 2 | 8 | 2 | | 2 | |
| | Sodium stearyl sulfate | | | | | | | | 2 | | 2 |
| | Sodium dodecylbenzene sulfonate | | | 3 | | | | | | | |
| | POE(5) tridecyl phosphate | | | | | | | | | | |
| Others | Glycerin | | | 2 | 2 | 2 | 2 | 2 | 2 | 2 | 2 |
| | Silicone KM-92 | | | 0.5 | 0.5 | 0.5 | 0.5 | 0.5 | 0.5 | 0.5 | 0.5 |
| | Antiseptic | | | 0.5 | 0.5 | 0.5 | 0.5 | 0.5 | 0.5 | 0.5 | 0.5 |
| | Water | | | 694 | 695 | 695 | 689 | 695 | 695 | 695 | 695 |
| Total | | | | 1000 | 1000 | 1000 | 1000 | 1000 | 1000 | 1000 | 1000 |
| Sewability | | | | 2.3 | 5.2 | 2.5 | 8.2 | 1.4 | 0.9 | 1.6 | 1.3 |
| Friction fastness | | Dry | | 3 to 4 | 3 | 3 to 4 | 4 | 3 | 3 | 3 | 3 |
| | | Wet | | 3 to 4 | 2 to 3 | 3 | 4 | 3 to 4 | 3 | 3 | 3 to 4 |
| Emulsifiability | | | | A | A | B2 | A | A | B1 | A | B1 |

INDUSTRIAL APPLICABILITY

The fabric treating agent of the present invention is suitable for interior material fabrics for vehicles including automobiles and trains, which are required to have excellent sewability because of the trend toward ultrafine fibers (made to fine denier) for the interior material fabrics especially for car seat, change in fabric structure from weave to knit, and increasing sewing machine speed for improved productivity.

What is claimed is:

1. A fabric treating agent comprising:

at least one wax (a) selected from the group consisting of a paraffin wax having a melting point of 60° C. or higher, an oxidized paraffin wax having a melting point of 60° C. or higher, a polyethylene wax having a melting point of 100° C. or higher, and an oxidized polyethylene wax having a melting point of 100° C. or higher; and a nonionic surfactant (b);

wherein said at least one wax (a) comprises a mixture of a paraffin wax component (a1) having a melting point of 60° C. or higher, and a polyethylene wax component (a2) comprising one or both of a polyethylene wax (a2A) having a melting point of 100° C. or higher and an oxidized polyethylene wax (a2B) having a melting point of 100° C. or higher, and wherein a weight ratio between the component (a1) and the component (a2) ranges from 98:2 to 50:50.

2. A fabric treating agent comprising:

at least one wax (a) selected from the group consisting of a paraffin wax having a melting point of 60° C. or higher, an oxidized paraffin wax having a melting point of 60° C. or higher, a polyethylene wax having a melting point of 100° C. or higher, and an oxidized polyethylene wax having a melting point of 100° C. or higher; and a nonionic surfactant (b);

wherein said at least one wax (a) comprises a mixture of a paraffin wax (a1) having a melting point of 60° C. or higher and an oxidized paraffin wax (a3) having a melting point of 60° C. or higher, and wherein a weight ratio between the component (a1) and the component (a3) ranges from 98:2 to 80:20.

3. The fabric treating agent according to claim 2, wherein a ratio of the wax (a) ranges from 60 to 90 wt % in a total of the wax (a) and the nonionic surfactant (b).

4. The fabric treating agent according to claim 2, wherein the fabric treating agent further comprises an anionic surfactant (c), and a ratio of the wax (a) ranges from 60 to 90 wt % in a total of the wax (a), the nonionic surfactant (b), and the anionic surfactant (c).

5. The fabric treating agent according to claim 4, wherein a weight ratio between the nonionic surfactant (b) and the anionic surfactant (c) ranges from 5:1 to 50:1.

6. A fabric treating agent comprising:

at least one wax (a) selected from the group consisting of a paraffin wax having a melting point of 60° C. or higher, an oxidized paraffin wax having a melting point of 60° C. or higher, a polyethylene wax having a melting point of 100° C. or higher, and an oxidized polyethylene wax having a melting point of 100° C. or higher;

a nonionic surfactant (b); and an anionic surfactant (c);

wherein a ratio of the wax (a) in a total of the wax (a), the nonionic surfactant (b), and the anionic surfactant (c) ranges from 60 to 90 wt %;

wherein said at least one wax (a) comprises a mixture of a paraffin wax (a1) having a melting point of 60° C. or higher and an oxidized paraffin wax (a3) having a melting point of 60° C. or higher, wherein a weight ratio between the component (a1) and the component (a3) ranges from 98:2 to 80:20;

and wherein the anionic surfactant is represented by the following chemical formula (1) or (2):

[Chem. 1]

$$R^1—OSO_3M^1 \quad (1)$$

(where $R^1$ is an alkyl group having from 8 to 40 carbon atoms or an alkenyl group having from 8 to 40 carbon atoms, $M^1$ is a hydrogen atom, alkaline metal, alkaline earth metal or a group represented by $NR^3R^4R^5R^6$, and each of $R^3$, $R^4$, $R^5$ and $R^6$ is independently a hydrogen atom or an organic group;

[Chem. 2]

$$R^2—SO_3M^2 \quad (2)$$

(where $R^2$ is an organic group having from 8 to 40 carbon atoms, $M^2$ is a hydrogen atom, alkaline metal, alkaline earth metal or a group represented by $NR^3R^4R^5R^6$, and each of $R^3$, $R^4$, $R^5$ and $R^6$ is independently a hydrogen atom or an organic group.)

7. The fabric treating agent according to claim 2, wherein the nonionic surfactant (b) comprises the following nonionic surfactants (b1), (b2), and (b3);

(b1): a nonionic surfactant having HLB of 1 to 7 (but excluding 7), and constituting 5 to 40 wt % of the nonionic surfactant (b), (b2): a nonionic surfactant having HLB of 7 to 14 (but excluding 14), and constituting 10 to 80 wt % of the nonionic surfactant (b), and (b3): a nonionic surfactant having HLB of 14 to 20 (but excluding 20), and constituting 5 to 40 wt % of the nonionic surfactant (b).

8. The fabric treating agent according to claim 2, wherein the wax (a) is in a state of an oil-in-water dispersion.

9. A process for producing fabric comprising: treating a fabric material with the fabric treating agent according to claim 2 by a dipping method, an impregnating method, a pad-dry method, spraying or coating.

10. The process for producing fabric according to claim 9, wherein the fabric material is manufactured of ultrafine fiber.

11. A vehicle interior material fabric being coated with the fabric treating agent according to claim 2, wherein the solids of the fabric treating agent are adhered on the fabric by 0.01 to 20 wt % of the fabric material.

12. The fabric treating agent according to claim 1, wherein a ratio of the wax (a) ranges from 60 to 90 wt % in a total of the wax (a) and the nonionic surfactant (b).

13. The fabric treating agent according to claim 1, wherein the fabric treating agent further comprises an anionic surfactant (c), and a ratio of the wax (a) ranges from 60 to 90 wt % in a total of the wax (a), the nonionic surfactant (b), and the anionic surfactant (c).

14. The fabric treating agent according to claim 13, wherein a weight ratio between the nonionic surfactant (b) and the anionic surfactant (c) ranges from 5:1 to 50:1.

15. The fabric treating agent according to claim 13, wherein the anionic surfactant is represented by the following chemical formula (1) or (2):

[Chem. 1]

$$R^1—OSO_3M^1 \quad (1)$$

(where $R^1$ is an alkyl group having from 8 to 40 carbon atoms or an alkenyl group having from 8 to 40 carbon atoms, $M^1$ is a hydrogen atom, alkaline metal, alkaline earth metal or a group represented by $NR^3R^4R^5R^6$, and each of $R^3$, $R^4$, $R^5$ and $R^6$ is independently a hydrogen atom or an organic group;

[Chem. 2]

$$R^2—SO_3M^2 \quad (2)$$

(where $R^2$ is an organic group having from 8 to 40 carbon atoms, $M^2$ is a hydrogen atom, alkaline metal, alkaline earth metal or a group represented by $NR^3R^4R^5R^6$, and each of $R^3$, $R^4$, $R^5$ and $R^6$ is independently a hydrogen atom or an organic group.)

16. The fabric treating agent according to claim 1, wherein the nonionic surfactant (b) comprises the following nonionic surfactants (b1), (b2), and (b3);

(b1): a nonionic surfactant having HLB of 1 to 7 (but excluding 7), and constituting 5 to 40 wt % of the nonionic surfactant (b), (b2): a nonionic surfactant having HLB of 7 to 14 (but excluding 14), and constituting 10 to 80 wt % of the nonionic surfactant (b), and (b3): a nonionic surfactant having HLB of 14 to 20 (but excluding 20), and constituting 5 to 40 wt % of the nonionic surfactant (b).

17. The fabric treating agent according to claim 1, wherein the wax (a) is in a state of an oil-in-water dispersion.

18. A process for producing fabric comprising: treating a fabric material with the fabric treating agent according to claim 1 by a dipping method, an impregnating method, a pad-dry method, spraying or coating.

19. The process for producing fabric according to claim 18, wherein the fabric material is manufactured of ultrafine fiber.

20. A vehicle interior material fabric being coated with the fabric treating agent according to claim 1, wherein the solids of the fabric treating agent are adhered on the fabric by 0.01 to 20 wt % of the fabric material.

* * * * *